US008118629B2

(12) United States Patent
Gallato

(10) Patent No.: US 8,118,629 B2
(45) Date of Patent: Feb. 21, 2012

(54) BUSHING APPARATUS FOR ELECTRICAL AND HYDRAULIC LINES ON A WATERCRAFT

(75) Inventor: Fernando Gallato, Padua (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 207 days.

(21) Appl. No.: 12/678,510

(22) PCT Filed: Sep. 26, 2008

(86) PCT No.: PCT/EP2008/062893

§ 371 (c)(1), (2), (4) Date: Mar. 17, 2010

(87) PCT Pub. No.: WO2009/047130

PCT Pub. Date: Apr. 16, 2009

(65) Prior Publication Data

US 2010/0210156 A1 Aug. 19, 2010

(30) Foreign Application Priority Data

Oct. 5, 2007 (DE) ..... 10 2007 048 056

(51) Int. Cl.
*B63H 5/125* (2006.01)

(52) U.S. Cl. ..... 440/61 T

(58) Field of Classification Search ..... 440/61 T, 440/77, 76

See application file for complete search history.

(56) References Cited

U.S. PATENT DOCUMENTS

| | | | | |
|---|---|---|---|---|
| 2,311,427 | A * | 2/1943 | Winkelmeyer | 16/108 |
| 2,579,973 | A * | 12/1951 | Schlosser | 439/519 |
| 3,587,511 | A | 6/1971 | Buddrus | |
| 3,596,626 | A | 8/1971 | Buddrus | |
| 4,492,421 | A * | 1/1985 | Ito | 439/271 |
| 4,969,847 | A * | 11/1990 | Curtis et al. | 440/77 |
| 5,637,021 | A * | 6/1997 | Watanabe | 440/77 |
| 6,923,695 | B2 * | 8/2005 | Ide et al. | 440/77 |
| 7,104,856 | B1 * | 9/2006 | Krupp et al. | 440/76 |
| 7,500,891 | B2 * | 3/2009 | Yazaki | 440/76 |
| 7,568,932 | B2 * | 8/2009 | O'Connor | 439/271 |
| 8,013,260 | B2 * | 9/2011 | Hartl | 174/650 |

FOREIGN PATENT DOCUMENTS

| | | |
|---|---|---|
| DE | 24 58 440 A1 | 6/1976 |
| DE | 202 20 645 U1 | 12/2003 |

* cited by examiner

*Primary Examiner* — Stephen Avila

(74) *Attorney, Agent, or Firm* — Davis & Bujold, P.L.L.C.

(57) ABSTRACT

A trimmable and controllable outside drive of a watercraft which comprises at least two actuators (113) for adjusting a thrust tube as well as at least one suspension apparatus (102) which can be fixed to a transom (101), for pivotally mounting the actuators (113). The drive comprises hydraulic (112) and electrical lines (111) for the actuators (113), the hydraulic or electrical energy for adjusting the actuators (113) and electrical signals from the sensors being transmitted by the lines. A bushing apparatus (100) is arranged on the transom (101) and the hydraulic (112) and/or electrical lines (111) are connected, via the bushing apparatus (100), both inside and outside the transom (113)).

8 Claims, 1 Drawing Sheet

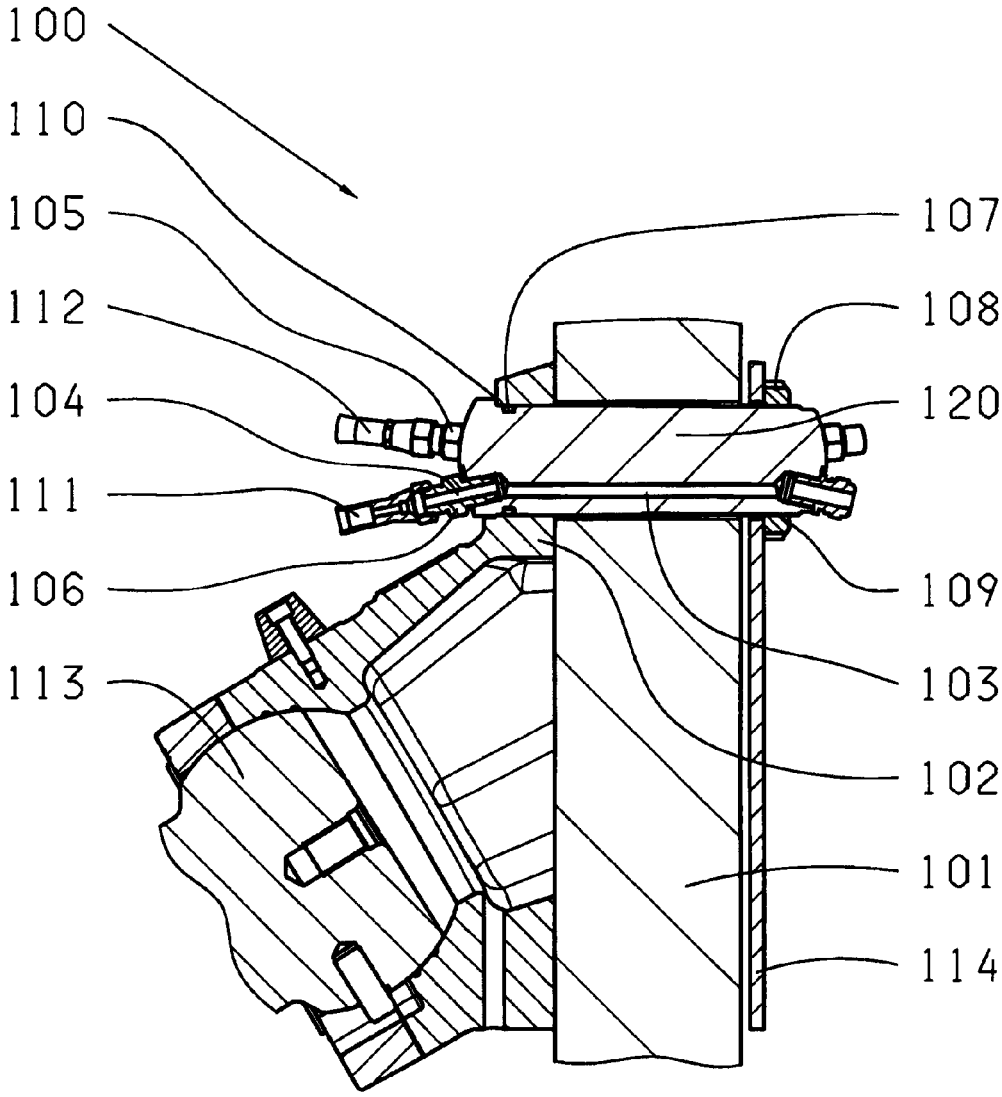
100
110
105
112
104
111
106
113
107
108
120
109
103
102
101
114

BUSHING APPARATUS FOR ELECTRICAL AND HYDRAULIC LINES ON A WATERCRAFT

This application is a National Stage completion of PCT/EP2008/062893 filed Sep. 26, 2008, which claims priority from German patent application serial no. 10 2007 048 056.5 filed Oct. 5, 2007.

FIELD OF THE INVENTION

The present invention relates to an external drive of a watercraft comprising at least two actuators for adjusting a thrust tube, at least one suspension apparatus, which can be fixed to a transom, for pivotably mounting the actuators, and hydraulic and electrical lines to the actuators.

BACKGROUND OF THE INVENTION

In trimmable and controllable external drives for watercrafts, it is known that the electrical and hydraulic lines required for controlling the actuators, as well as sensing the position of the adjusted drive, are connected from the interior of the watercraft via numerous bushings through the transom of the watercraft. Separate sealing is required at each bushing; in addition, the numerous drill holes weaken the structure of the transom. If the apparatus has to be removed, for example for maintenance, the hydraulic lines have to be pulled out of their bushings and the seals need to be replaced as a result. In addition, the lines either have to be awkwardly disconnected in the interior of the watercraft or in an environmentally critical way outside the watercraft.

SUMMARY OF THE INVENTION

The objective of the present invention is to provide a bushing apparatus for hydraulic and/or electrical lines with which the above mentioned disadvantages of the known arrangement can be avoided, and a simple and easy to install connection between a hydraulic or electrical line inside and outside the watercraft can be accomplished.

A trimmable and controllable external drive of a watercraft comprises at least two actuators for adjusting a thrust tube as well as at least one suspension apparatus, which can be fixed to a transom, for pivotably mounting the actuators. Furthermore, the drive comprises hydraulic and electrical lines to the actuators, the hydraulic or electrical energy for adjusting the actuators and electrical signals from sensors being transmitted by the lines. For this purpose, a bushing apparatus can be arranged on the transom, by means of the bushing apparatus the hydraulic and/or electrical lines are connected inside and outside the transom. Thus, for passing all lines of one or more actuators through the transom only one opening is required, which is sealed against the bushing apparatus once the bushing apparatus has been installed.

In an advantageous refinement of the subject matter of the present invention, the bushing apparatus has continuous channels, with connections being arranged on the ends of each channel for electrical and/or hydraulic lines.

In addition, according to an embodiment of the present invention, the continuous channels between the connections for hydraulic lines may be empty and an electrical connection can be arranged between the connections for the electrical lines, whose type and function corresponds to that of the electrical line of the actuator.

Preferably, in this case, the connections are designed as connecting elements which are sealed and fixed in a housing of the bushing apparatus. If the housing of the bushing apparatus is made of an electrically conductive material, the electrical connecting elements are isolated against the housing of the bushing apparatus.

In one variant, the bushing apparatus is fixed to the transom and sealed.

In another advantageous variant, the external contour of the housing of the bushing apparatus is cylindrical. The installation in the transom by means of a drilling process is very easy in this way. Moreover, a cylindrical body is easy to seal in a drill hole.

In this regard, a further embodiment provides that the bushing apparatus is arranged in a suspension apparatus, which is fixed to the transom.

Preferably, the bushing apparatus is guided radially in the suspension apparatus and sealed. The suspension apparatus is radially sealed by means of a sealing element. Likewise, an exact fit can be created in the metallic material by means of a clearance fit.

It is also possible to pull out the bushing apparatus toward the inside or outside after releasing an attachment. This is advantageous for installing and removing the bushing apparatus.

BRIEF DESCRIPTION OF THE DRAWING

The present invention will be explained in more detail hereinafter with reference to the exemplary embodiment shown in the drawing:

The drawing shows:

a longitudinal section of the bushing apparatus as mounted in the suspension apparatus.

DETAILED DESCRIPTION OF THE PREFERRED EMBODIMENTS

The drawing shows a cross-section of the transom 101 of a watercraft in the region of the bushing apparatus 100. The bushing apparatus 100 has channels 103 in its longitudinal direction, a connecting element 105 for a hydraulic line 112, or a connecting element 106 for an electrical line 111 being connected to both ends of the channels 103. The connecting elements 106 for an electrical line 111 are in electrical contact via an electrical connection 104. The electrical connection 104 is isolated against the housing of the bushing apparatus 120. The channel 103 has a straight course which was drilled into the housing of the bushing apparatus 120. The straight shape is particularly advantageous for the hydraulic connections because this minimizes the losses of flow. The housing of the bushing apparatus 120 is cylindrical and is made, for example, of a stainless metallic material in order to withstand the hydraulic pressure on the one hand, and to resist the corrosive environmental conditions on the other hand. The hydraulic 112 and electrical 111 lines are screwed onto the connecting elements 105, 106, by which the lines from the interior of the watercraft are connected to the lines of the actuators. During installation into the shown mounting position, the bushing apparatus 100 is pushed from the left side through a drill hole in the suspension apparatus 102, in which the housing of the bushing apparatus 120 is guided in a fitting, and further through a drill hole in the transom 101 until the collar 110 abuts against the suspension apparatus 102. On the opposite side, meaning the inside of the transom 101, a ring nut 108 is screwed onto a thread 109 for attaching the bushing apparatus 100, wherein the ring nut 108 is abuts against the counterplate 114 on the inside of the transom 101 to avoid damaging the transom 101. Subsequently, the lines are fixed from the inside. This results in easy disassemble without having to disconnect the lines 111, 112 coming from the actuator. In the assembled position shown, sealing at the outer diameter of the housing of the bushing apparatus 120 is carried out by means of a sealing element.

REFERENCE NUMERALS

100 bushing apparatus
101 transom
102 suspension apparatus
103 channel
104 electrical connection
105 connecting element for a hydraulic line
106 connecting element for an electrical line
107 sealing element
108 ring nut
109 thread
110 collar
111 electrical line
112 hydraulic line
113 actuator
114 counterplate
120 housing of the bushing apparatus

The invention claimed is:

1. A trimmable and controllable outside drive for a watercraft, the outside drive comprising at least two actuators (113) for adjusting a thrust tube, at least one suspension apparatus (102) being is fixed to a transom (101) for pivotably mounting the actuators (113) and hydraulic (112) and electrical (111) lines to the actuators (113), a bushing apparatus (100) for permitting passage of at least one of the hydraulic (112) and the electrical (111) lines through the transom (101), a plurality of continuous channels (103) being configured in a housing of the bushing apparatus (120), the plurality of channels (103) have connections (105, 106) for at least one of the electrical (111) and the hydraulic lines (112) on opposed ends of each of the plurality of channels (103), and the channels (103) being empty between the connections (105) for the hydraulic lines and an electrical connection (104) being arranged between the connections (105) for the electrical lines.

2. The trimmable and controllable outside drive according to claim 1, wherein the connections (105, 106) are connecting elements which are sealingly fixed in the housing of the bushing apparatus (120).

3. The trimmable and controllable outside drive according to claim 1, wherein a sealing means is provided between the bushing apparatus (100) and the transom (101).

4. The trimmable and controllable outside drive, according to claim 1, wherein an external contour of the housing of the bushing apparatus (120) is cylindrical.

5. The trimmable and controllable outside drive, according to claim 1, wherein the bushing apparatus (100) is arranged in a suspension apparatus (102) which is fixed to the transom (101), and the actuator (113) is pivotably mounted in the suspension apparatus (102).

6. The trimmable and controllable outside drive according to claim 1, wherein the bushing apparatus (100) is guided in the suspension apparatus (102) and sealed by a sealing element (107).

7. The trimmable and controllable outside drive according to claim 1, wherein, after releasing an attachment (107, 108, 109), the bushing apparatus (100) is force toward either an outside or an inside of the transom (101).

8. A trimmable and controllable outside drive for a watercraft, the outside drive comprising:

at least two actuators (113) being fixed, via at least one suspension apparatus (102), to a transom (101), the at least two actuators (113) being pivotably supported by the at least one suspension apparatus (102) for adjusting a thrust tube, and of the suspension apparatus (102) and the transom (101) both having an aperture;

a bushing apparatus having a housing (120) which extends through the apertures of the suspension apparatus (102) and the transom (101) and being fixed therein by a ring nut (108) for securing the suspension apparatus (102) to the transom (101);

the housing of the bushing apparatus (120) comprising a plurality of channels (103) extending therethrough, hydraulic line connecting elements (105) being coupled to the housing of the bushing apparatus (120) at opposite ends of one of the plurality of channels (103) and electrical line connecting elements (106) being coupled to the housing of the bushing apparatus (120) at opposite ends of another one of the plurality of channels (103);

the at least two actuators (113) comprising an electrical line (111) and a hydraulic line (112), the electrical line (111) being coupled to the electrical line connecting elements (106) and the hydraulic line (112) being coupled to the hydraulic line connecting element (105); and the plurality of channels (103) facilitating sealed electrical and hydraulic communication between the electrical line (111) and the hydraulic line (112), located on an exterior side of the transom (101), and the associated hydraulic line connecting element (105) and the electrical line connecting element (106), located on an interior side of the transom (101).

* * * * *